US011747026B2

(12) United States Patent
Lim et al.

(10) Patent No.: US 11,747,026 B2
(45) Date of Patent: Sep. 5, 2023

(54) OUTDOOR UNIT FOR AIR CONDITIONER

(71) Applicant: SAMSUNG ELECTRONICS CO., LTD., Suwon-si (KR)

(72) Inventors: Changsoo Lim, Suwon-si (KR); Kyusang Park, Suwon-si (KR); Hyeonu Park, Suwon-si (KR); Chungwan Yuk, Suwon-si (KR); Junwoo Kim, Suwon-si (KR); Jeimin Choi, Suwon-si (KR); Hansuk Lee, Suwon-si (KR); Duju Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 32 days.

(21) Appl. No.: 17/236,182

(22) Filed: Apr. 21, 2021

(65) Prior Publication Data

US 2021/0325056 A1 Oct. 21, 2021

(30) Foreign Application Priority Data

Apr. 21, 2020 (KR) ..... 10-2020-0047925

(51) Int. Cl.
*F24F 1/36* (2011.01)
*F24F 1/14* (2011.01)
(Continued)

(52) U.S. Cl.
CPC ..... *F24F 1/36* (2013.01); *F24F 1/14* (2013.01); *F24F 1/16* (2013.01); *F24F 13/32* (2013.01); *F24F 13/222* (2013.01)

(58) Field of Classification Search
CPC ..... F24F 1/14; F24F 1/16; F24F 1/36; F24F 13/22; F24F 13/222; F24F 13/32
See application file for complete search history.

(56) References Cited

U.S. PATENT DOCUMENTS

2014/0131024 A1* 5/2014 Iwazaki ..... F24F 1/06 165/185
2015/0000321 A1* 1/2015 Kagawa ..... F24F 13/222 62/291

(Continued)

FOREIGN PATENT DOCUMENTS

CN 203869193 U 10/2014
EP 1 259 765 11/2002

(Continued)

OTHER PUBLICATIONS

Extended European Search Report dated Sep. 15, 2021 in European Patent Application No. 21169322.1.

(Continued)

*Primary Examiner* — Joseph F Trpisovsky
(74) *Attorney, Agent, or Firm* — STAAS & HALSEY LLP

(57) ABSTRACT

Provided is an outdoor unit of an air conditioner. The outdoor unit of the air conditioner includes a heat exchanger, a base arranged below the heat exchanger and including a first part including a drain hole formed to correspond to the heat exchanger to discharge water generated from the heat exchanger, and a second part formed to have a stepped portion with the first part, and a leg provided below the base and including a panel formed to slope while being spaced apart from the base such that the water is discharged through the drain hole.

19 Claims, 15 Drawing Sheets

(51) Int. Cl.

| | |
|---|---|
| ***F24F 13/32*** | (2006.01) |
| ***F24F 1/16*** | (2011.01) |
| *F24F 13/22* | (2006.01) |

(56) References Cited

U.S. PATENT DOCUMENTS

| | | | | |
|---|---|---|---|---|
| 2016/0076779 | A1 | 3/2016 | Lee et al. | |
| 2016/0076796 | A1* | 3/2016 | Lee | F24F 1/46 62/498 |
| 2019/0137118 | A1 | 5/2019 | Otsuka et al. | |
| 2022/0268455 | A1* | 8/2022 | Satou | F28F 1/325 |

FOREIGN PATENT DOCUMENTS

| | | | |
|---|---|---|---|
| EP | 1 259 765 | B1 | 11/2002 |
| JP | 2000-130800 | | 5/2000 |
| JP | 2002-081693 | | 3/2002 |
| JP | 2012-242026 | | 12/2012 |
| JP | 2014-098512 | | 5/2014 |
| JP | 2015-90225 | | 5/2015 |
| JP | 6610691 | | 11/2019 |
| KR | 20-1990-0008638 | | 9/1990 |
| KR | 10-1428444 | | 8/2014 |
| KR | 10-1439813 | | 9/2014 |
| KR | 10-2016-0031230 | | 3/2016 |
| KR | 10-2016-0031232 | | 3/2016 |
| KR | 10-2016-0031394 | | 3/2016 |
| KR | 10-2016-0073606 | | 6/2016 |
| KR | 10-2017-0001705 | | 1/2017 |
| KR | 10-2017-0002349 | | 1/2017 |
| KR | 10-1753955 | | 7/2017 |
| KR | 10-2340914 | | 12/2021 |
| WO | WO 01/65184 | A2 | 9/2001 |

OTHER PUBLICATIONS

International Search Report for PCT Application No. PCT/KR2021/004521 dated Jul. 1, 2021.

* cited by examiner

OUTDOOR UNIT FOR AIR CONDITIONER

CROSS-REFERENCE TO RELATED APPLICATION

This application is based on and claims priority under 35 U.S.C. § 119 to Korean Patent Application No. 10-2020-0047925, filed on Apr. 21, 2020 in the Korean Intellectual Property Office, the disclosures of which are incorporated herein by reference.

BACKGROUND

1. Field

The disclosure relates to an outdoor unit of an air conditioner, and more specifically, to an outdoor unit of an air conditioner capable of effectively removing water generated from a heat exchanger.

2. Description of the Related Art

In general, an air conditioner refers to a device that adjusts temperature, humidity, airflow, distribution of air, etc. to be suitable for human activities using a refrigeration cycle. Main components of the refrigeration cycle include a compressor, a condenser, an evaporator, and a blower fan.

The air conditioner may be divided into a separate type air conditioner in which an indoor unit and an outdoor unit are installed separately from each other, and an integrated type air conditioner in which an indoor unit and an outdoor unit are installed together in a single cabinet. The outdoor unit of the separate type air conditioner may include a heat exchanger for heat-exchanging air that is suctioned into the outdoor unit and a base for supporting the heat exchanger and other components.

During the operation of the refrigeration cycle, condensate or defrost water may be generated, but condensate or defrost water, unless discharged effectively, may be frozen and adversely affect the operation of the product.

SUMMARY

According to an aspect of the disclosure, there is provided an outdoor unit of an air conditioner including: a heat exchanger; a base arranged below the heat exchanger and including a first part including a drain hole formed to correspond to the heat exchanger to discharge water generated from the heat exchanger, and a second part formed to have a step difference with the first part; and a leg provided below the base and including a panel formed to be inclined while being spaced apart from the base such that the water is discharged through the drain hole.

The panel may be formed to slope with respect to an outer side of the base such that the water discharged through the drain hole is caused to flow.

The panel may be formed to slope downward from the outer side of the base to an inner side of the base.

The base may further include an edge portion on which the heat exchanger is arranged, and the first part may be formed to protrude upward from the edge portion to support the heat exchanger.

The first part may form a stepped portion with the second part such that the water generated in the heat exchanger flows from the first part to the second part.

The drain hole may be a contact drain hole configured to come in contact with the heat exchanger, and the outdoor unit of the air conditioner may further include at least one non-contact drain hole.

The base may further include a bottom plate forming a bottom of the base and having a stepped portion with the edge portion, and the at least one non-contact drain hole may include a first non-contact drain hole arranged on the edge portion and a second non-contact drain hole arranged on the bottom plate.

The first non-contact drain hole may be formed at a corner of the edge portion.

The first part may have an outer side length shorter than an inner side length such that the water generated in the heat exchanger flows from an outer side to an inner side of the base.

The base may further include a base wall forming an outer wall of the base and a connection portion connecting the base wall to the first part.

The leg may include a leg drain hole formed to correspond to the drain hole.

The panel may include a first panel portion and a second panel portion, and the first panel portion may be formed to be inclined while being spaced apart from the base, and the second panel portion may come in contact with an outer surface of the base to support the base.

The first panel portion and the second panel portion may be alternately arranged.

The first part may be formed to be recessed from the base toward the leg such that the second part supports the heat exchanger.

The second part may form a stepped portion with the first part such that the water generated in the heat exchanger flows from the second part to the first part.

According to another aspect of the disclosure, there is provided an outdoor unit of an air conditioner including: a heat exchanger; a base arranged below the heat exchanger, and including a contact portion including a drain hole formed to come in contact with the heat exchanger to discharge water generated from the heat exchanger, and a non-contact portion formed to have a stepped portion with the contact portion; and a leg provided below the base, and including a first panel portion formed to be inclined while being spaced apart from the base such that water is discharged through the drain hole, and a second panel portion configured to come in contact with the base to support the base.

The first panel portion and the second panel portion may be alternately provided.

The base may further include an edge portion on which the heat exchanger is arranged, and the leg may be arranged adjacent to the edge portion.

According to another aspect of the disclosure, there is provided an outdoor unit of an air conditioner including: a heat exchanger; a base arranged below the heat exchanger and including an edge portion formed on an outer side of the base; and a leg provided below of the base, wherein the base includes a drain hole in the edge portion to discharge water generated from the heat exchanger.

The base may further include: a contact portion configured to come in contact with the heat exchanger to support the heat exchanger; and a non-contact portion in which the drain hole is formed, wherein the contact portion has a stepped portion with the non-contact portion such that water generated in the heat exchanger flows to the non-contact portion.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
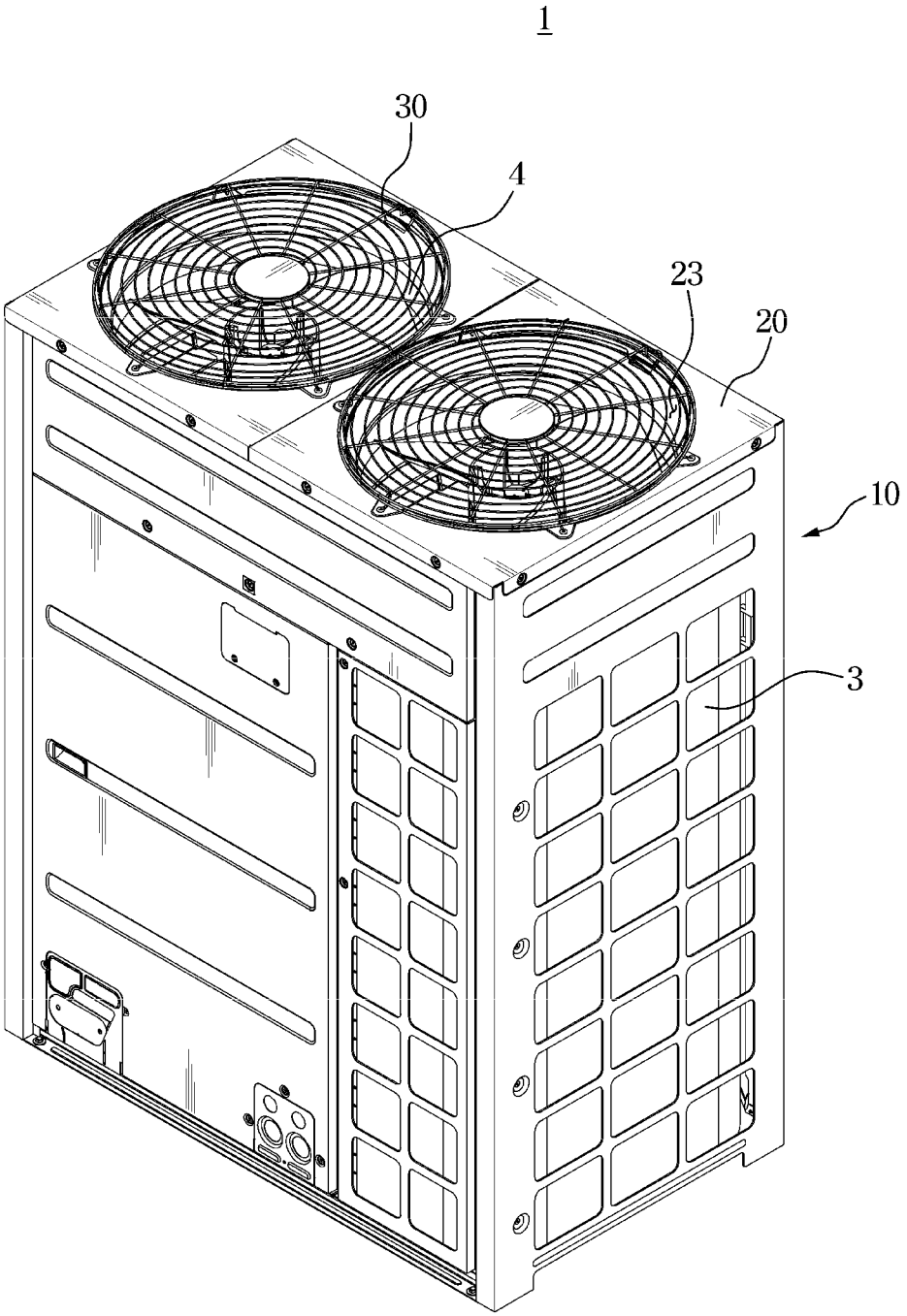
FIG. 1 is a perspective view illustrating an outdoor unit of an air conditioner according to an embodiment of the disclosure.

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, stepped portions, operations, elements, and/or components, but do not preclude the presence or addition of one or more other features, integers, stepped portions, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components. For example, the direction in which a front cabinet (see FIG. 1) of an outdoor unit of an air conditioner according to an embodiment of the disclosure is directed is referred to as 'front', and the direction in which a rear cabinet (not shown) is directed is described as referred to as 'rear'.

Hereinafter, embodiments of the disclosure will be described in detail with reference to the accompanying drawings.

It is an aspect of embodiments of the disclosure to provide an outdoor unit of an air conditioner facilitating discharge of defrost water or condensed water.

Figure 2:
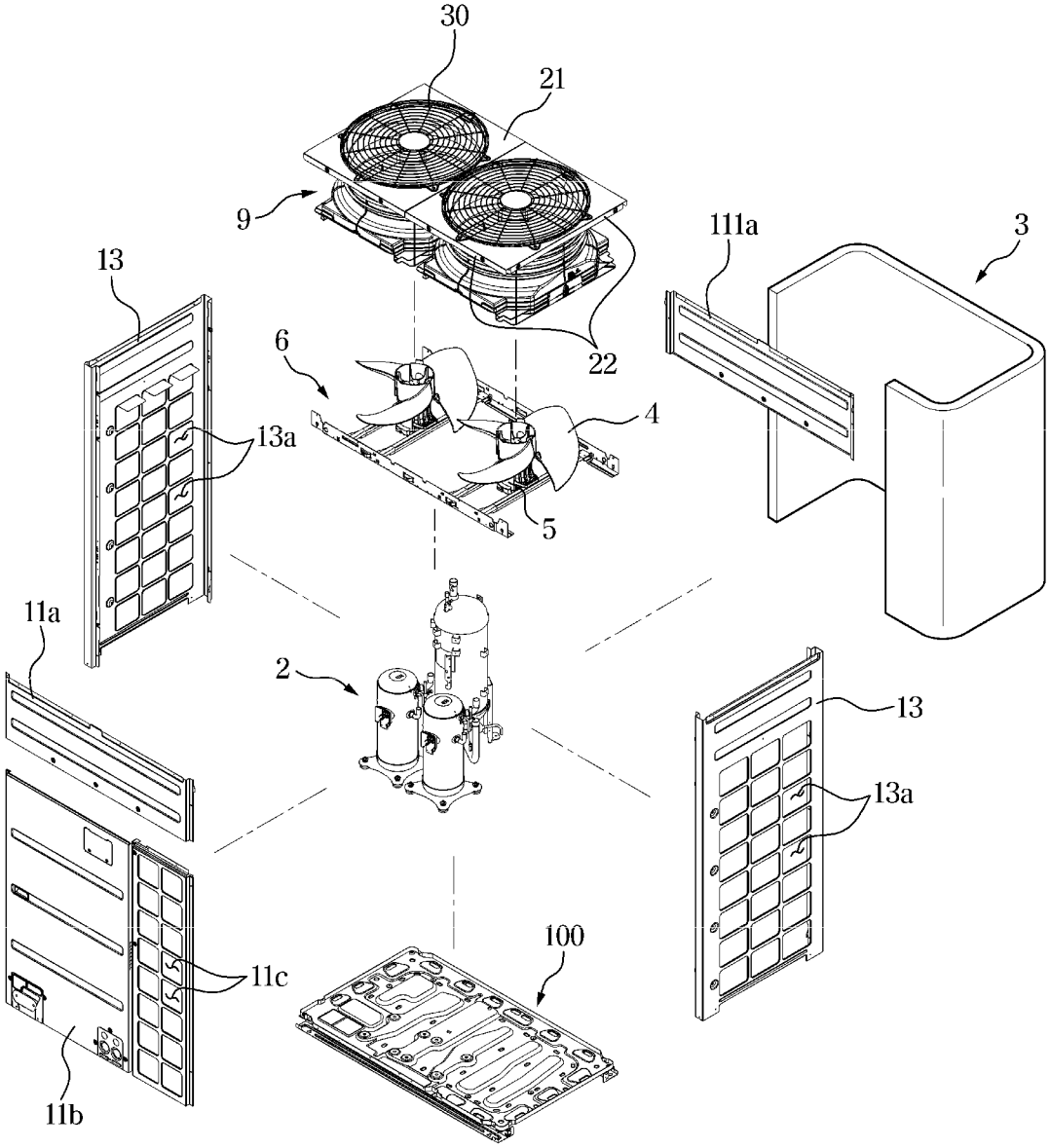
FIG. 2 is an exploded perspective view illustrating the outdoor unit of the air conditioner shown in FIG. 1.

It is another aspect of embodiments of the disclosure to provide an outdoor unit of an air conditioner having reduced material costs and component costs. FIG. 1 is a perspective view illustrating an outdoor unit of an air conditioner according to an embodiment of the disclosure. FIG. 2 is an exploded perspective view illustrating the outdoor unit of the air conditioner shown in FIG. 1.

Referring to FIGS. 1 and 2, the outdoor unit includes a cabinet 10 forming the external appearance of the outdoor unit, a compressor 2 arranged inside the cabinet 10 to compress a refrigerant, a heat exchanger 3 performing heat-exchange with outdoor air, a blower fan 4 allowing outdoor air to pass through the body of the outdoor unit while heat-exchanging with the heat exchanger 3, and a driving motor 5 for rotating the blower fan 4.

The cabinet 10 may form four surfaces of the outdoor unit 1. In the drawing, the blower fan 4 is illustrated as being provided in two units, but the number of the blower fan is not limited thereto, and the blower fan 4 may include one blower fan or three or more blower fans.

In addition, the outdoor unit 1 of the air conditioner may include a blower fan cover 20 arranged above the blower fan 4 and the cabinet 10 to cover the blower fan 4 and the cabinet 10 and a base 100 arranged below the cabinet 10 and on which components of a refrigeration cycle including the compressor 2 are seated.

The cabinet 10 has a front cabinet 11 arranged at a front side of the outdoor unit 1 of the air conditioner, a rear cabinet 12 arranged at a rear side of the outdoor unit 1, and a pair of side cabinets 13 arranged on both sides of the air conditioner that are perpendicular to each other.

The pair of side cabinets 13 have a symmetrical structure, and the following description will be made in relation to only one side cabinet 13 among the pair of side cabinets 13. However, when describing the pair of side cabinets 13 as needed, 'a pair of side cabinets 13' will be mentioned, and when describing one side cabinet 13, 'a side cabinet 13' will be mentioned.

The blower fan cover 20 includes an upper panel 21 provided with a discharge port 23 formed to discharge air heat-exchanged with the heat exchanger 3 through the blower fan 4 and an extension portion 22 formed to extend from an edge of the upper panel 21 downward.

The blower fan 4 may be arranged on the upper side in the cabinet 10. A cylindrical molded body 9 may be provided radially outside the blower fan 4 to guide air from the blower fan 4 to the discharge port 23.

The heat exchanger 3 may be formed to be bent and extend on the side in which the pair of side cabinets 13 and the rear cabinet 12 are arranged. That is, the heat exchanger 3 may be provided to cover four surfaces. Accordingly, the side cabinet 13 may include a side suction port 13*a* such that air is suctioned into the outdoor unit 1 of the air conditioner and heat-exchanged with the heat exchanger 3.

In addition, the rear cabinet 12, unlike the front cabinet 11 and the side cabinet 13, has a short vertical length to form an opening (not shown) below the rear cabinet 12 between the rear cabinet 12 and the side cabinet 13. Air is introduced into the outdoor unit 1 of the air conditioner through the side suction port 13*a*, the opening (not shown), and a front suction port 11*c*, and after being heat-exchange with the heat exchanger 3, discharged out of the outdoor unit 1 of the air conditioner through the discharge port 23 provided at the upper side of the outdoor unit 1 of the air conditioner.

The front cabinet 11 may be divided into a front upper cabinet 11*a* and a front lower cabinet 11*b*. The front cabinet 11 may include the suction port 11*c* through which air is introduced into the outdoor unit 1 of the air conditioner to be exchange-heated with the heat exchanger 3. That is, the front cabinet 11 may include the three components 11*a*, 11*b*, and 11*c*. However, the disclosure is not limited to thereto, and the front cabinet 11 may be provided as an integral shape.

The rear cabinet 12 may be provided in a size corresponding to the front upper cabinet 11*a*. The rear cabinet 12 may be provided to extend downward from the side where the blower fan cover 20 is arranged together with the front cabinet 11, and have a vertical length corresponding to the length of the front upper cabinet 11*a*.

However, the disclosure is not limited thereto, and the rear cabinet 12 may be provided to extend downward of the front upper cabinet 11*a*, and may extend to correspond to the entire length of the front cabinet 10.

A blow fan coupling portion 6 may be arranged inside the cabinet 10.

The cylindrical molded body 9 may be coupled to an inside surface of the upper panel 21 of the blower fan cover 20. In addition, a fan guard 30 may be provided on the upper side of the upper panel 21 to protect the discharge port 23. The blower fan cover 20 includes the extension portions 22 extending downward from the four side edges of the upper panel 21, and the extension portions 22 may be formed to cover upper ends of the front cabinet 11, the rear cabinet 12, and the side cabinets 13.

In detail, the extension portion 22 is arranged outside the cabinet 10 and extends downward from the upper panel 21, so that at least a portion of the upper side of each of the cabinets 11, 12, and 13 is covered.

When the outdoor unit 1 operates, the heat exchanger 3 may operate. As the outdoor unit 1 drives the refrigeration cycle, condensed water or defrost water may be generated in the heat exchanger 3. That is, condensed water may be generated during cooling, and defrosted water may be generated during heating.

When condensate or defrost water is generated but not discharged smoothly, the water may be frozen and adversely affect the operation of the product. In addition, since a defrost operation is required to remove the condensed water or defrost water, the efficiency of the air conditioner may be lowered. Therefore, a structure for removing condensed water or defrosted water is required in the outdoor unit 1.

Figure 3:
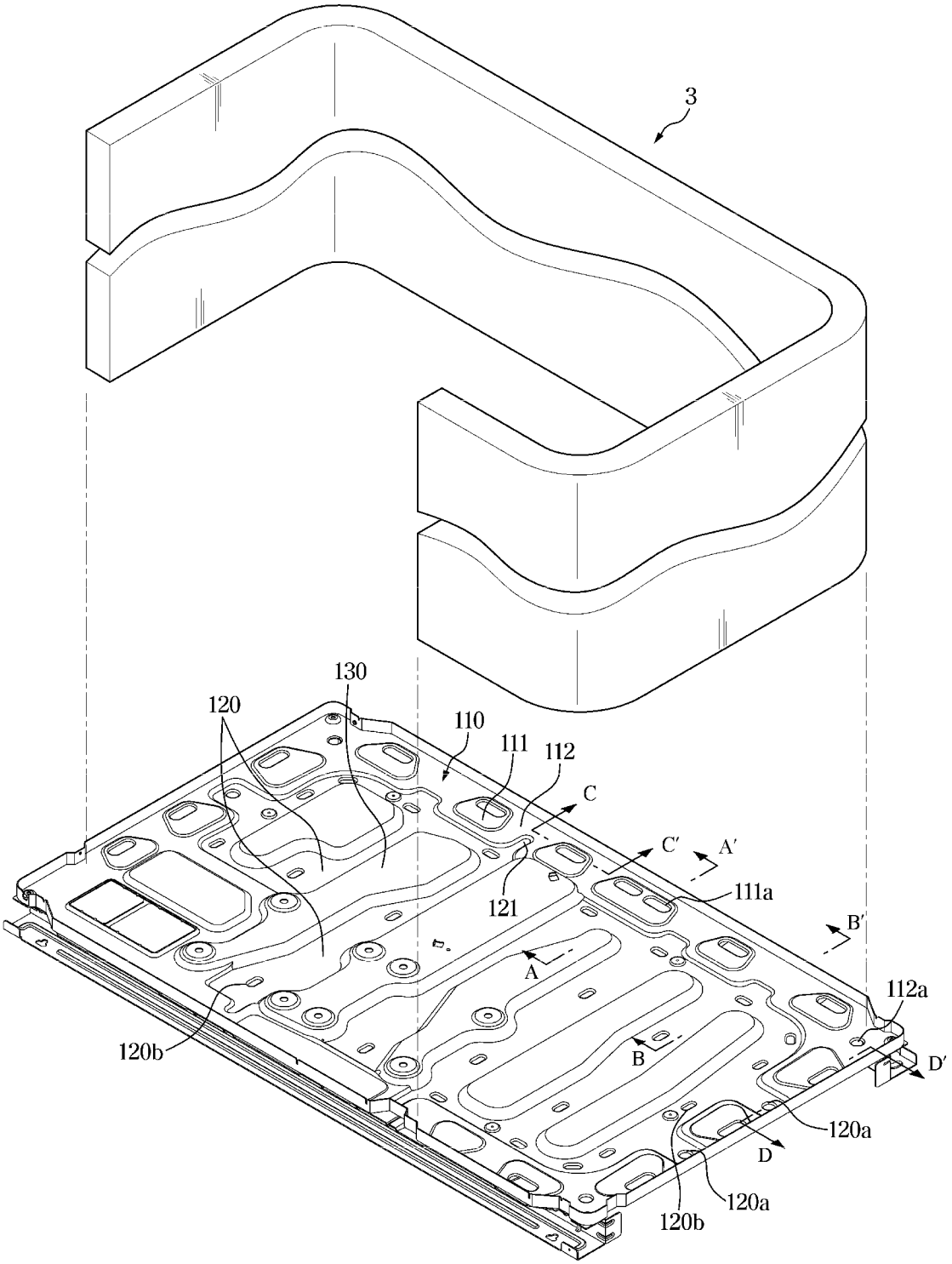
FIG. 3 is a perspective view illustrating a base of the outdoor unit of the air conditioner shown in FIG. 1.

FIG. 3 is a perspective view illustrating a base of the outdoor unit of the air conditioner shown in FIG. 1.

Referring to FIG. 3, the base 100 may include an edge portion 110, a bottom plate 120, and a seating plate 130. The edge portion 110 may be formed to correspond to a region in which the heat exchanger 3 is arranged on the outer side of the base 100.

The edge portion 110 may include a first part 111 and a second part 112.

The first part 111 may represent a contact portion 111 and the second part 112 may represent a non-contact portion 112. The heat exchanger 3 may be arranged on the contact portion 111. The contact portion 111 may support the heat exchanger 3 while in contact with the lower portion of the heat exchanger 3. The non-contact portion 112 may be arranged below the heat exchanger 3.

The contact portion 111 may further include a drain hole 111*a* through which water generated from the heat exchanger 3 is discharged. In the heat exchanger 3, defrost water or condensed water may be generated due to a cooling or heating operation. When defrost water or condensed water is not removed efficiently, the water may condense and may cause malfunction of the heat exchanger 3 and the outdoor unit 1. Therefore, frequent defrosting operation may be required. The drain hole 111*a* may allow water to be efficiently removed. The drain hole 111*a* may form a contact drain hole 111*a* configured to come in contact with the heat exchanger 3.

The contact portion 111 and the non-contact portion 112 may be formed to have a stepped portion d1 between each other. That is, the contact portion 111 may be formed to protrude further from the edge portion 110 than the non-contact portion 112. Accordingly, water generated in the heat exchanger 3 may flow from the contact portion 111 to the non-contact portion 112 and may be discharged through non-contact drain holes 112*a* and 120*a* to be described below.

The base 100 may further include at least one non-contact drain hole 112*a* and 120*a*. The at least one non-contact drain hole 112*a* and 120*a* may include a first non-contact drain hole 112*a* and a second non-contact drain hole 120*a*.

The first non-contact drain hole 112*a* may be formed in the edge portion 110 so as to be formed at a position corresponding to the heat exchanger 3. That is, the first non-contact drain hole 112*a* may be formed at a corner portion of the base 100.

The bottom plate 120 may form the lowest surface of the base 100. The bottom plate 120 may be formed at an inner side of the base 100. The bottom plate 120 may include the second non-contact drain hole 120*a* and a bottom drain hole 120*b*. The second non-contact drain hole 120*a* may be formed in the bottom plate 120. The second non-contact drain hole 120*a* may be formed in the edge portion 110. That is, the second non-contact drain hole 120*a* may be formed in a region that corresponds to both the edge portion 110 and the bottom plate 120.

The bottom drain hole 120*b* may be formed in the bottom plate 120. The bottom drain hole 120*b* may be formed to have a small size so that small animals may not enter the outdoor unit. The bottom drain hole 120*b* may be provided in plural.

The outdoor unit 1 of the air conditioner may further include a leg 90 provided at a lower side of the base 100 to support the base 100. The leg 90 may be attached to a long side of the base 100 to support the base 100 and the outdoor unit 1. However, the disclosure is not limited thereto, and the leg 90 may be attached to a short side of the base 100 to support the base 100 and the outdoor unit 1.

The base 100 may further include a fastening hole 121 to be fastened with the leg 90. The fastening hole 121 may be provided in at least one unit thereof.

The seating plate 130 may be provided to seat the components of the refrigeration cycle including the compressor 2 described above thereon. The seating plate 130 may form a stepped portion d3 with the bottom plate 120.

The base 100 may further include a base wall 140. The base wall 140 may extend upward from the outer side of the base 100.

Figure 4:
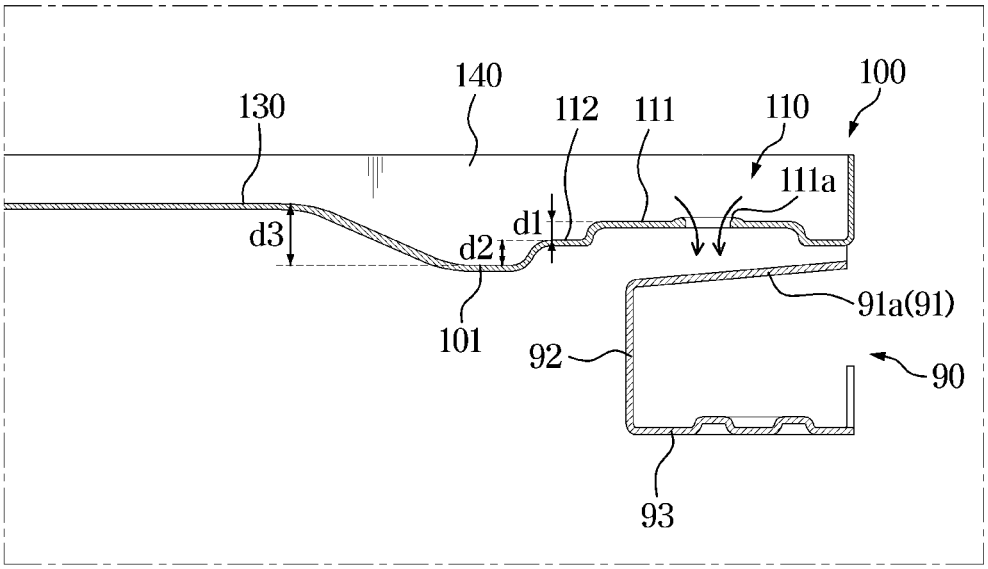
FIG. 4 is a cross-sectional view taken along line A-A' of the base shown in FIG. 3.
Figure 5:
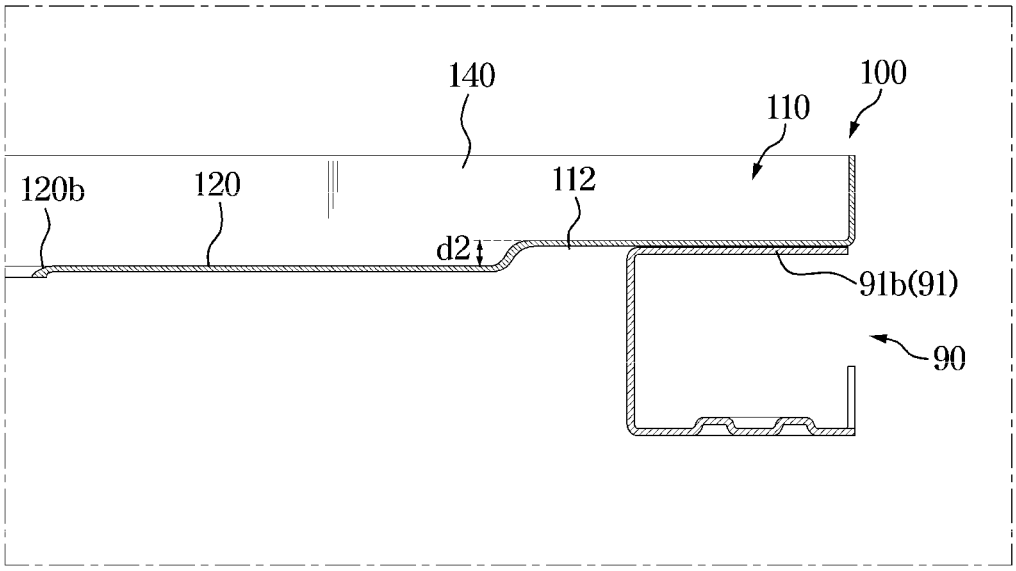
FIG. 5 is a cross-sectional view taken along line B-B' of the base shown in FIG. 3.

FIG. 4 is a cross-sectional view taken along line A-A' of the base shown in FIG. 3. FIG. 5 is a cross-sectional view taken along line B-B' of the base shown in FIG. 3.

Referring to FIGS. 4 and 5, the first part 111 may include the drain hole 111*a*. The drain hole 111*a* may be formed vertically below the heat exchanger 3 so that water generated in the heat exchanger 3 is discharged to the outside (see FIG. 3).

Water (defrost water or condensed water) discharged from the drain hole 111*a* may be discharged through the leg 90 arranged below the base 100. The leg 90 may be formed to be spaced a predetermined distance from the base 100 so that water discharged from the drain hole 111*a* is easily discharged. In addition, the base 100 may be formed to slope downward in a direction from the outside to the inside.

The leg 90 may include a first panel 91, a second panel 92, and a third panel 93. The first panel 91 may be formed to be inclined with respect to the base 100 so that water is caused to flow. The second panel 92 may be formed to be bent from the first panel 91 and extend downward. The third panel 93 may be formed to be bent from the second panel 92 and extend so as to face the first panel 91. The third panel 93 may be formed to allow the leg 90 to support the ground.

The first panel 91 may include a first panel portion 91*a* and a second panel portion 91*b*. The first panel portion 91*a* may be formed to be inclined with respect to the base 100, and the second panel portion 91*b* may come in contact with the base 100 to support the base 100.

The first part 111 and the second part 112 may form a stepped portion d1 with each other. That is, water may flow from the first part 111 to the second part 112. The water flowing to the second part 112 may flow to the bottom plate 120 or may flow to the first non-contact drain hole 112*a* formed in the corner portion to be discharged to the outside.

The second part 112 and the bottom plate 120 may also form a stepped portion d2 with each other. That is, water may flow from the second part 112 to the bottom plate 120. Water flowing to the bottom plate 120 may be discharged to the outside through the bottom drain hole 120*b* or the second non-contact drain hole 120*a* formed in the bottom plate 120.

The bottom plate 120 and the seating plate 130 may also form a stepped portion d3 with each other.

Figure 6:
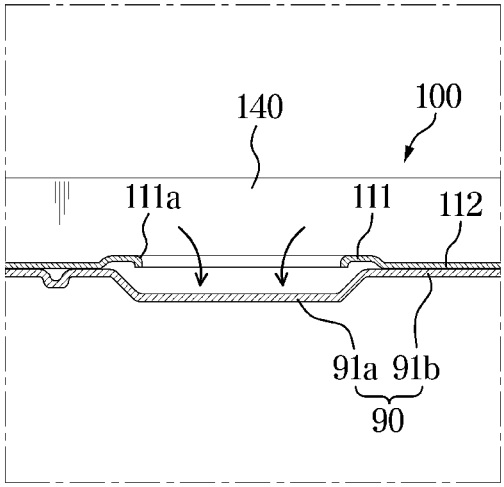
FIG. 6 is a cross-sectional view taken along line C-C' of the base shown in FIG. 3.
Figure 7:
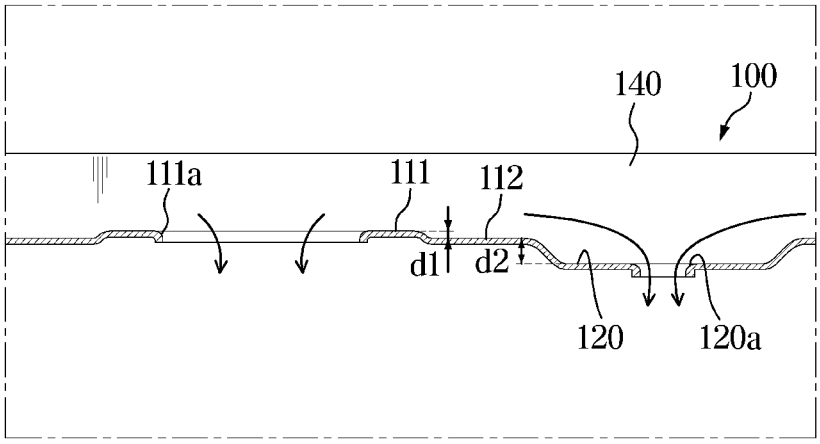
FIG. 7 is a cross-sectional view taken along line D-D' of the base shown in FIG. 3.

FIG. 6 is a cross-sectional view taken along line C-C' of the base shown in FIG. 3, which shows a cross-section of the base taken in a long side direction. FIG. 7 is a cross-sectional view taken along line D-D' of the base shown in FIG. 3, which shows a cross-section of the base taken in a short side direction.

Referring to FIGS. 6 and 7, water discharged from the contact drain hole 111*a* of the first part 111 may be discharged to the outside through the first panel portion 91*a*. The second panel portion 91*b* may support the base 100 while in contact with the edge of the base 100. That is, the second panel portion 91*b* may come in contact with the second part 112 to support the base 100. Although not shown in FIG. 6, the first panel portion 91*a* may include a slope.

Since the first part 111 and the second part 112 form a stepped portion d1 with each other, and the second part 112 forms a stepped portion d2 with the bottom plate 120, water may flow from the first part 111 to the bottom plate 120 to be discharged through the second non-contact drain hole 120*a*. In the drawing, the contact drain hole 111*a* is illustrated larger than the second non-contact drain hole 120*a*, but the disclosure is not limited thereto, and the second non-contact drain hole 120*a* may be provided larger than the contact drain hole 111*a*.

Figure 8:
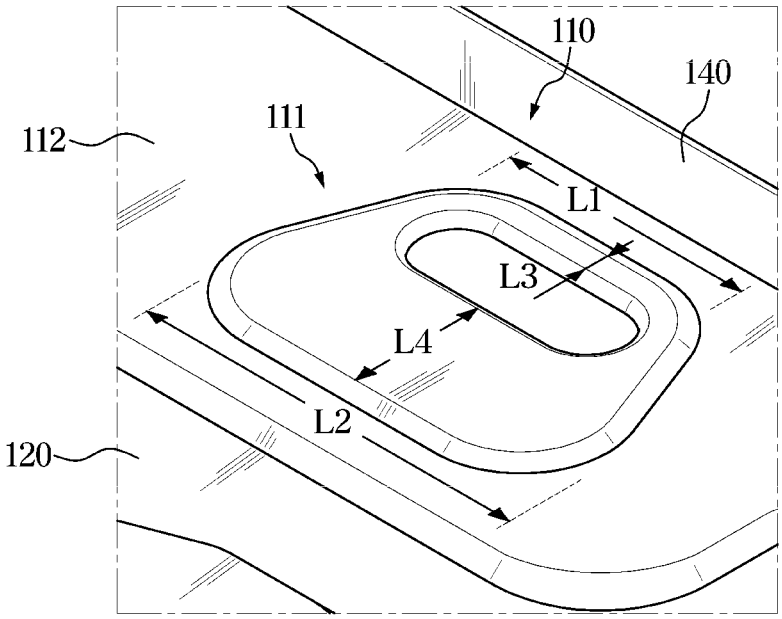
FIG. 8 is a view illustrating a first part of the base shown in FIG. 3.

FIG. 8 is a view illustrating a first part of the base shown in FIG. 3.

Referring to FIG. 8, according to the embodiment, the first part 111 represents a part that comes in contact with the heat exchanger 3 and supports the heat exchanger 3.

The first part 111 may be formed on the edge portion 110. An outer side length L1 of the first part 111 may be shorter than an inner side length L2. Since the outer side length L1 is formed short, water remaining at an outer side of the first part 111 may flow rapidly inward. That is, the first part 111 may be provided in a trapezoidal shape. Since the first part 111 has a trapezoidal shape, an area coming in contact with the heat exchanger 3 is increased, so that the heat exchanger 3 may be stably supported.

The contact drain hole 111*a* may be formed adjacent to an outer side compared to an inner side of the base 100. That is, L4 may be longer than L3. Since the heat exchanger 3 generates a large amount of condensed water or defrost water at the outer side of the heat exchanger 3 during heat exchange with air, the contact drain hole 111*a* may be formed adjacent to the outer side of the base 100.

In FIG. 8, the first part 111 is illustrated as being further protruded upward from the edge portion relative to the second part 112, but the disclosure is not limited thereto, and the second part 112 may be further protruded upward from the edge portion relative to the first part 111.

Figure 9:
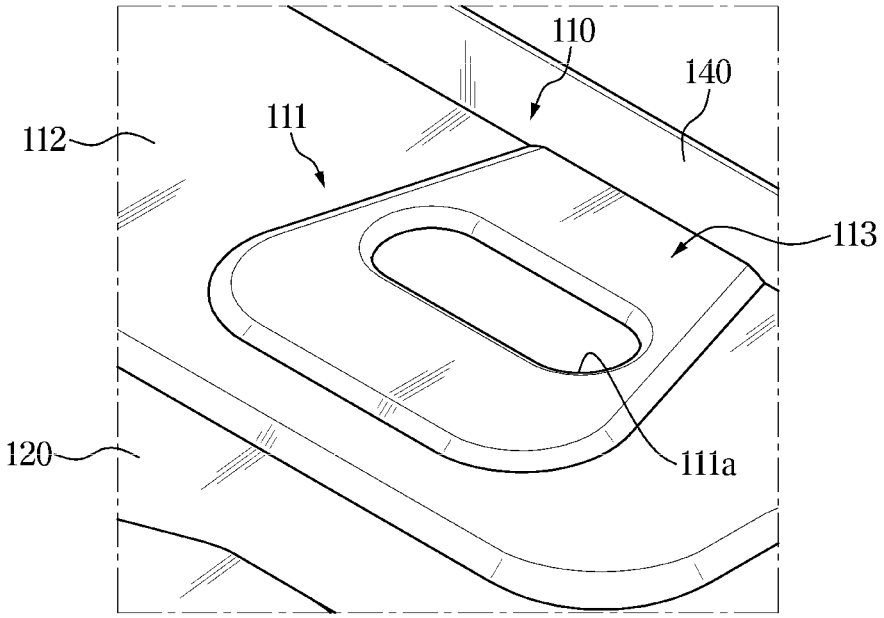
FIG. 9 is a view illustrating a first part of an outdoor unit of an air conditioner according to another embodiment of the disclosure.
Figure 10:
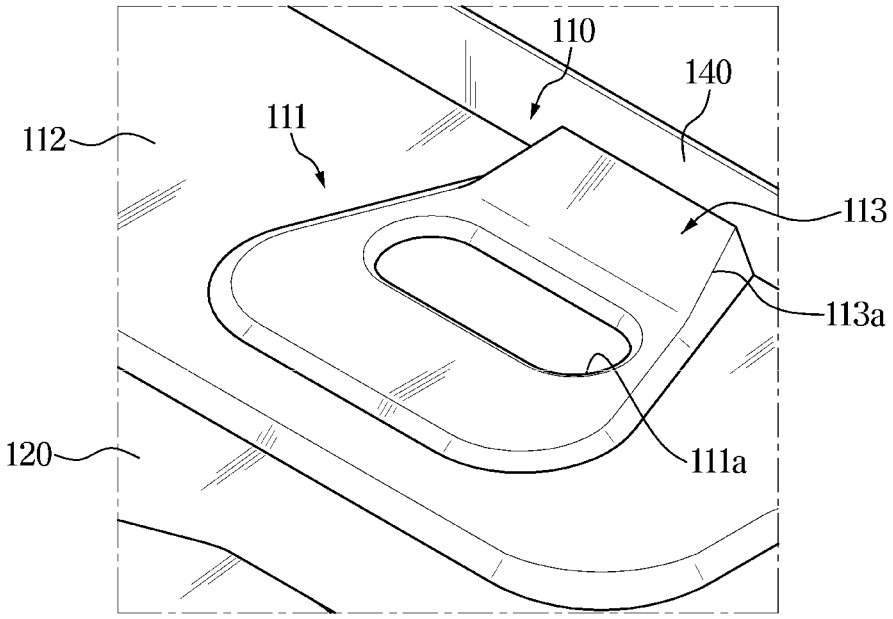
FIG. 10 is a view illustrating a first part of an outdoor unit of an air conditioner according to another embodiment of the disclosure.

FIG. 9 is a view illustrating a first part of an outdoor unit of an air conditioner according to another embodiment of the disclosure. FIG. 10 is a view illustrating a first part of an outdoor unit of an air conditioner according to another embodiment of the disclosure.

Referring to FIGS. 9 and 10, the base 110 may further include a connection portion 113. The connection portion 113 may be connected to remove an empty part between the first part 111 and the base wall 140. That is, the connection portion 113 may be provided as a protrusion that connects the first part 111 to the base wall 140. Accordingly, water remaining in the first part 111 may be discharged through the contact drain hole 111*a* without being collected.

In addition, the connection portion 113 may include a slope 113*a*. The slope 113*a* allows water remaining in the connection portion 113 to flow to the contact drain hole 111*a* or the non-contact drain holes 112*a* and 120*a*. That is, the connection portion 113 may be formed to slope downward from the outer side to the inner side of the base 100. Accordingly, water generated in the heat exchanger 3 may be efficiently discharged.

Figure 11:
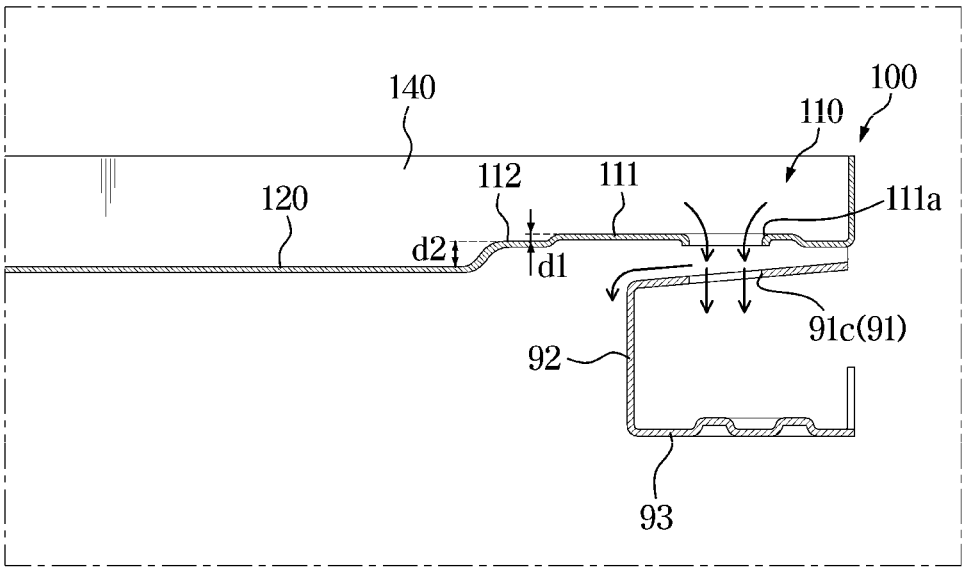
FIG. 11 is a view illustrating a coupled state of a base and a leg in an outdoor unit of an air conditioner according to another embodiment of the disclosure.

FIG. 11 is a view illustrating a coupled state of a base and a leg in an outdoor unit of an air conditioner according to another embodiment of the disclosure.

Referring to FIG. 11, the leg 90 may include a leg drain hole 91*c*. The leg drain hole 91*c* may be formed in the first panel 91. That is, the leg drain hole 91*c* may be formed in the first panel portion 91*a*.

Since the leg drain hole 91*c* is formed in the first panel portion 91*a*, water generated in the heat exchanger 3 may be discharged to the outside from the leg drain hole 91*c* directly through the contact drain hole 111*a*. In addition, the water may be discharged toward the inner side of the base 100 through the slope of the first panel portion 91*a*.

Figure 12:
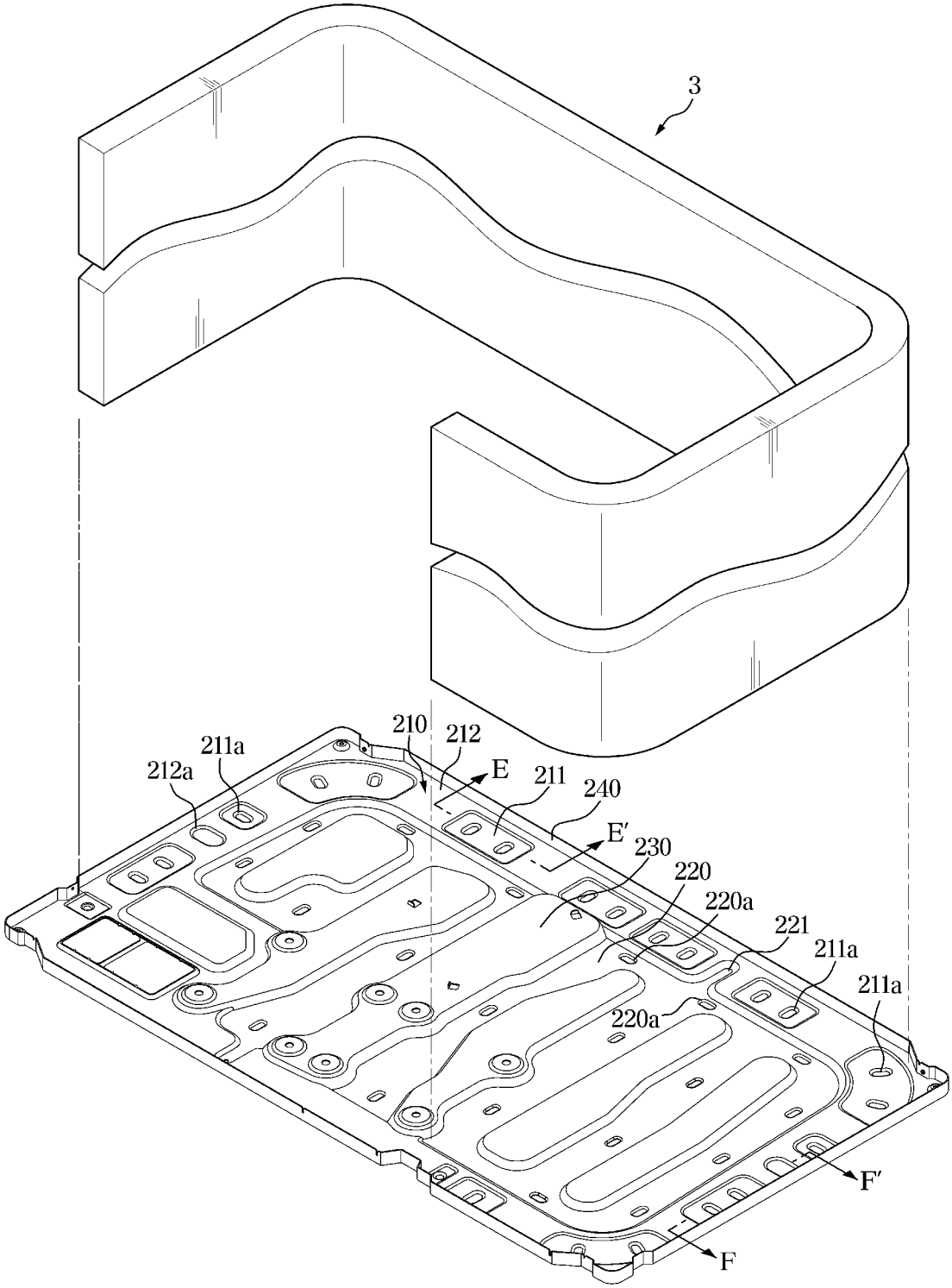
FIG. 12 is a perspective view illustrating a base of an outdoor unit of an air conditioner according to another embodiment of the disclosure.

FIG. 12 is a perspective view illustrating a base of an outdoor unit of an air conditioner according to another embodiment of the disclosure. In FIG. 12, the leg 90 is omitted.

Referring to FIG. 12, a base 200 may include an edge portion 210, a bottom plate 220, and a seating plate 230. The edge portion 210 may be formed to correspond to a region in which the heat exchanger 3 is arranged on the outer side of the base 200.

The edge portion 210 may include a first part 211 and a second part 212.

The first part 211 may represent a non-contact portion 211, and the second part 212 may represent a contact portion 212. The heat exchanger 3 may be arranged on the contact portion 212. The contact portion 212 may support the heat exchanger 3 while in contact with the lower portion of the heat exchanger 3. The non-contact portion 211 may be arranged below the heat exchanger 3.

The non-contact portion 211 may further include a drain hole 211*a* through which water generated in the heat exchanger 3 is discharged. The drain hole 211*a* may be a non-contact drain hole 211*a* that does not come in contact with the heat exchanger 3. The contact portion 212 may include a contact drain hole 212*a*.

The contact portion 212 and the non-contact portion 211 may be formed to have a stepped portion d1 between each other. That is, the non-contact portion 211 may be formed as a recession in the contact portion 212. Accordingly, the contact portion 212 may be formed higher than the non-contact portion 211. As a result, water generated in the heat exchanger 3 may flow from the contact portion 212 to the non-contact portion 211, and may be discharged through the non-contact drain hole 211*a*.

The non-contact drain hole 211*a* may be formed in the edge portion 210 of the base 200 so as to be formed at a position corresponding to the heat exchanger 3. That is, the non-contact drain hole 211*a* may be formed in all of the long side, short side, and corner portions of the base 200. The non-contact drain hole 211*a* may be provided in plural.

The bottom plate 220 may include a bottom drain hole 220*a*. The bottom drain hole 220*a* may be formed in the bottom plate 220. The bottom drain hole 220*a* may be formed to have a small size so that small animals may not enter the outdoor unit 1. The bottom drain hole 220*a* may be provided in plural.

The base 200 may further include a fastening hole 221 to be fastened with the leg. The fastening hole 221 may be provided in at least one unit thereof.

The seating plate 230 may be provided to seat the components of the refrigeration cycle including the compressor 2 described above thereon. The seating plate 230 may form a stepped portion d3 with the bottom plate 220.

The base 200 may further include a base wall 240. The base wall 240 may extend upward from the outer side of the base 200.

Figure 13:
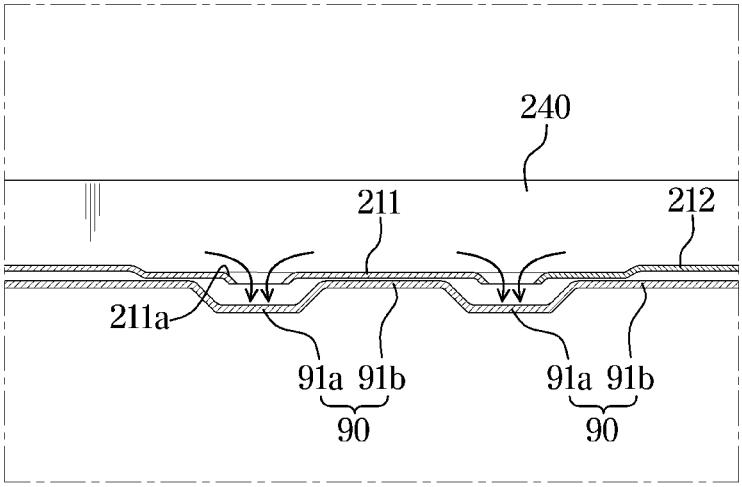
FIG. 13 is a cross-sectional view taken by E-E' of the base shown in FIG. 12.
Figure 14:
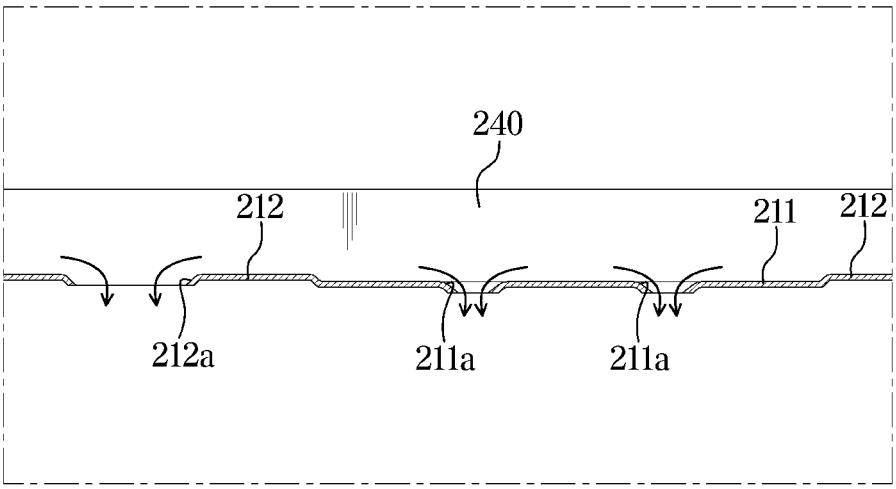
FIG. 14 is a cross-sectional view taken along F-F' of the base shown in FIG. 12.

FIG. 13 is a cross-sectional view taken by E-E' of the base shown in FIG. 12, which shows a cross-section of the base taken in a long side direction. FIG. 14 is a cross-sectional view taken along F-F' of the base shown in FIG. 12, which shows a cross-section of the base taken in a short side direction.

Referring to FIGS. 13 and 14, water discharged from the non-contact drain hole 211*a* of the first part 211 may be discharged to the outside through the first panel portion 91*a*. Although not shown in FIG. 11, the first panel portion 91*a* may include a slope.

Since the first part 211 and the second part 212 form a stepped portion d1 with each other, water generated from the heat exchanger 3 in an area adjacent to the second part 212 may flow to the first part 211 to thereby be discharged from the non-contact drain hole 211*a* through the leg 90.

Figure 15:
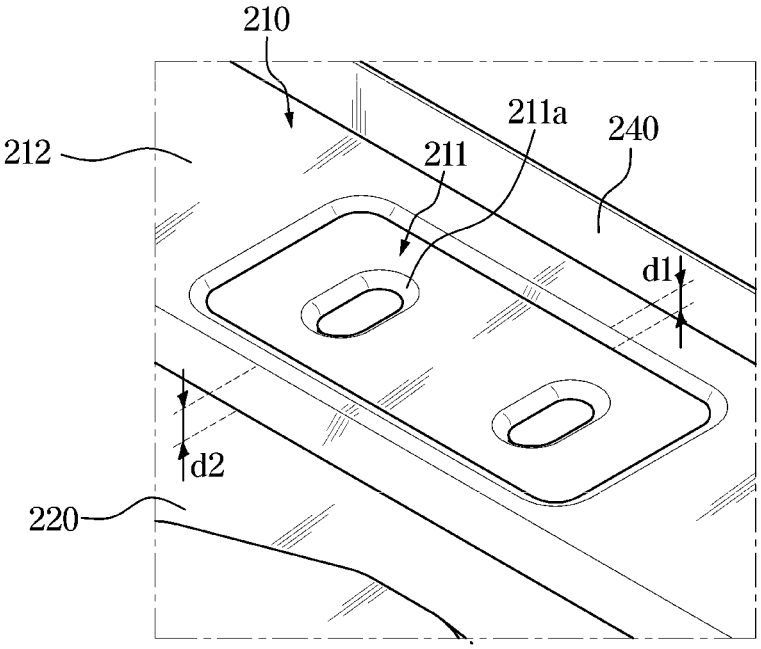
FIG. 15 is a view illustrating a second part of the base shown in FIG. 12.

FIG. 15 is a view illustrating a second part of the base shown in FIG. 12.

Referring to FIG. 15, the second part 212 according to the embodiment represents a part that comes in contact with the heat exchanger 3 and supports the heat exchanger 3.

The first part 211 may be formed as a recession that is further depressed from the base 100 relative to the second part 212. The first part 211 may include at least one discharge hole 211*a* to discharge water generated in the heat exchanger 3. The discharge hole 211*a* may represent a non-contact discharge hole 211*a*. Since the first part 211 is further depressed than the second part 212, water remaining in a region of the second part 212 adjacent to the heat exchanger 3 flows into the first part 211 to thereby be discharged through the non-contact drain hole 211*a*.

The second part 212 may have a stepped portion d2 with the bottom plate 220. Accordingly, water remaining in a region of the second part 212 adjacent to the heat exchanger 3 may flow to the bottom plate 220 to thereby be discharged to the outside through the bottom drain hole 220*a*.

As is apparent from the above, defrost water or condensed water generated in the heat exchanger can be effectively discharged through the base.

Since defrost water or condensed water is easily discharged through the drain hole, additional material cost and components cost can be reduced.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. An outdoor unit of an air conditioner comprising:

a heat exchanger that generates water while the outdoor unit operates;

a base below the heat exchanger and including:

a first part including a drain hole extending through the first part and corresponding to the heat exchanger so as to receive a first portion of the water generated by the heat exchanger, and a second part having a step difference with the first part so as to receive a second portion of the water generated by the heat exchanger; and a leg below the base to support the base and including:

a first panel that includes a first panel portion that is spaced apart from the base and inclined with respect to a direction in which the first portion of the water is discharged through the drain hole so that the first portion of the water discharged through the drain hole is received on the first panel portion and flows downward along the first panel portion, and a second panel portion that comes into contact with an outer surface of the base to support the base, a second panel that extends down from the first panel, and a third panel that is bent from the second panel and allows the leg to be supported on the ground.

2. The outdoor unit of claim 1, wherein the first panel portion is formed to slope with respect to an outer side of the base.

3. The outdoor unit of claim 2, wherein the first panel portion is formed to slope downward from the outer side of the base to an inner side of the base.

4. The outdoor unit of claim 1, wherein the base further includes an edge portion on which the heat exchanger is arranged, and the first part is formed to protrude upward from the edge portion to support the heat exchanger.

5. The outdoor unit of claim 4, wherein the first part forms a stepped portion with the second part so that the second portion of water generated by the heat exchanger flows from the first part to the second part.

6. The outdoor unit of claim 4, wherein the drain hole is a contact drain hole configured to come in contact with the heat exchanger, and the outdoor unit of the air conditioner further comprises at least one non-contact drain hole.

7. The outdoor unit of claim 6, wherein the base further includes a bottom plate forming a bottom of the base and having a stepped portion with the edge portion, and the at least one non-contact drain hole includes a first non-contact drain hole arranged on the edge portion and a second non-contact drain hole arranged on the bottom plate.

8. The outdoor unit of claim 7, wherein the first non-contact drain hole is formed at a corner of the edge portion.

9. The outdoor unit of claim 1, wherein the first part has an outer side length shorter than an inner side length so that the second portion of water generated by the heat exchanger flows from an outer side of the base to an inner side of the base.

10. The outdoor unit of claim 1, wherein the base further includes a base wall forming an outer wall of the base and a connection portion connecting the base wall to the first part.

11. The outdoor unit of claim 1, wherein the leg includes a leg drain hole.

12. The outdoor unit of claim 4, wherein the first panel portion and the second panel portion are alternately arranged along a length of the edge portion.

13. The outdoor unit of claim 1, wherein the first part is recessed from the base toward the first panel so that the second part supports the heat exchanger.

14. The outdoor unit of claim 13, wherein the second part forms a stepped portion with the first part so that the second portion of the water generated by the heat exchanger flows from the second part to the first part.

15. An outdoor unit of an air conditioner comprising:

a heat exchanger that generates water while the outdoor unit operates;

a base arranged below the heat exchanger and including:

a contact portion including a drain hole formed to come in contact with the heat exchanger so as to receive a first portion of the water generated by the heat exchanger, and a non-contact portion having a stepped portion with respect to the contact portion so as to receive a second portion of the water generated by the heat exchanger; and a leg below the base and including:

a first panel that includes a first panel portion spaced apart from the base and inclined with respect to a direction in which the first portion of the water is discharged through the drain hole so that the first portion of the water discharged through the drain hole is received on the first panel portion and flows downward along the first panel portion, and a second panel portion in contact with the base to support the base, a second panel that extends down from the first panel, and a third panel that is bent from the second panel and allows the leg to be supported on the ground.

16. The outdoor unit of claim 15, wherein the base further includes an edge portion on which the heat exchanger is arranged and the first panel portion and the second panel portion are arranged alternately alonq a length of the edge portion.

17. The outdoor unit of claim 15, wherein the base further includes an edge portion on which the heat exchanger is arranged, and the leg is adjacent to the edge portion.

18. An outdoor unit of an air conditioner comprising:

a heat exchanger that generates water while the outdoor unit operates;

a base below the heat exchanger and including:

an edge portion on an outer side of the base, and a drain hole extending through the edge portion so as to receive a first portion of the water generated by the heat exchange; and a leg that includes:

a first panel that includes a first panel portion spaced apart from the base and configured so as to receive the first portion of the water discharged through the drain hole, the first panel portion being sloped so that the discharge water flows downward along the first panel portion, and a second panel portion in contact with and supporting the base, the first panel portion and second panel portion being arranged alternately along a length of the base, a second panel that extends down from the first panel, and a third panel that is bent from the second panel and allows the leg to be supported on the ground.

19. The outdoor unit of claim 18, wherein the base further includes:

a contact portion in contact with the heat exchanger to support the heat exchanger; and a non-contact portion in which the drain hole is formed, wherein the contact portion has a stepped portion with respect to the non-contact portion so that a second portion of water generated by the heat exchanger flows to the non-contact portion.

* * * * *